US011098939B2

(12) United States Patent
Pfeiffer et al.

(10) Patent No.: US 11,098,939 B2
(45) Date of Patent: Aug. 24, 2021

(54) ICE MAKER FOR A DOMESTIC REFRIGERATION APPLIANCE WITH AN EJECTION UNIT AND A TWISTING APPARATUS, DOMESTIC REFRIGERATION APPLIANCE AND METHOD

(71) Applicant: BSH HAUSGERAETE GMBH, Munich (DE)

(72) Inventors: Klaus Pfeiffer, Heidenheim (DE); Hans Gerd Keller, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 104 days.

(21) Appl. No.: 16/025,543

(22) Filed: Jul. 2, 2018

(65) Prior Publication Data

US 2019/0011164 A1 Jan. 10, 2019

(30) Foreign Application Priority Data

Jul. 10, 2017 (DE) ..... 10 2017 211 714.1

(51) Int. Cl.

| | |
|---|---|
| ***F25C 5/06*** | (2006.01) |
| ***F25C 5/04*** | (2006.01) |
| ***F25C 5/20*** | (2018.01) |
| ***F25C 1/04*** | (2018.01) |

(52) U.S. Cl.

CPC ..... *F25C 1/04* (2013.01); *F25C 5/04* (2013.01); *F25C 5/06* (2013.01); *F25C 5/22* (2018.01)

(58) Field of Classification Search

CPC .... F25C 1/22; F25C 1/24; F25C 1/243; F25C 5/04; F25C 5/06; F25C 5/185; F25C 5/22; F25C 2700/06; F25C 2700/14; F25C 1/10; F25C 1/08; F25C 1/125; F25C 5/02; F25C 5/20; F25C 2305/022

See application file for complete search history.

(56) References Cited

U.S. PATENT DOCUMENTS

| | | | | |
|---|---|---|---|---|
| 3,677,030 | A * | 7/1972 | Nicholas | F25C 1/04 62/353 |
| 9,170,042 | B2 * | 10/2015 | Tenbarge | F25C 5/06 |
| 10,101,071 | B2 * | 10/2018 | Oh | F25C 1/24 |
| 10,309,707 | B2 * | 6/2019 | Visin | F25C 1/10 |

(Continued)

FOREIGN PATENT DOCUMENTS

| | | | |
|---|---|---|---|
| DE | 102010038378 A1 * | 1/2012 | F25C 1/24 |
| DE | 102010038378 A1 | 1/2012 | |

*Primary Examiner* — Jianying X Atkisson
*Assistant Examiner* — Miguel A Diaz
(74) *Attorney, Agent, or Firm* — Laurence A. Greenberg; Werner H. Stemer; Ralph E. Locher

(57) ABSTRACT

An ice maker for a domestic refrigeration appliance has an ice tray with at least one cavity for holding and freezing liquids to form a shaped ice element. An ejection unit ejects the shaped ice element from the cavity. A drive apparatus performs a relative rotational movement between the ice tray and the ejection unit to eject the shaped ice element from the cavity. The ice maker has a twisting apparatus that is coupled to the ice tray and that can be used to twist the ice tray around to release a frozen shaped ice element in the cavity. There is also described a domestic refrigeration appliance with the ice maker and a method for ejecting shaped ice elements from the ice tray.

8 Claims, 5 Drawing Sheets

(56) References Cited

U.S. PATENT DOCUMENTS

2006/0032262 A1* 2/2006 Seo ..... F25C 1/20 62/340
2006/0207282 A1* 9/2006 Visin ..... F25C 1/24 62/351
2010/0229590 A1* 9/2010 Riccardi ..... F25C 1/04 62/345
2012/0180504 A1* 7/2012 An ..... F25C 5/06 62/71
2013/0152617 A1* 6/2013 Oh ..... F25C 1/24 62/351
2013/0291581 A1* 11/2013 Cox ..... F25C 5/06 62/340
2013/0291583 A1* 11/2013 Bauman ..... F25C 1/24 62/340
2014/0123687 A1* 5/2014 Visin ..... F25C 5/04 62/71
2014/0165611 A1* 6/2014 Boarman ..... F25C 1/18 62/3.63
2014/0165622 A1* 6/2014 Boarman ..... F25C 1/10 62/72
2014/0165643 A1* 6/2014 Boarman ..... F25C 1/10 62/340
2014/0260348 A1* 9/2014 Visin ..... F25C 1/243 62/71
2014/0260406 A1* 9/2014 Tenbarge ..... F25C 5/06 62/340
2015/0308725 A1* 10/2015 Friedmann ..... F25C 1/10 62/344
2015/0338146 A1* 11/2015 Keller ..... F25C 1/04 62/139
2015/0362242 A1* 12/2015 Bauriedl ..... F25C 5/06 62/340
2016/0116198 A1* 4/2016 Becker ..... F25C 1/243 62/66
2017/0336124 A1* 11/2017 Visin ..... F25C 1/18
2018/0245832 A1* 8/2018 Ji ..... F25C 5/04
2019/0011164 A1* 1/2019 Pfeiffer ..... F25C 5/06
2019/0011166 A1* 1/2019 Bertolini ..... F25C 5/22
2019/0068031 A1* 2/2019 Saito ..... H02K 11/33
2019/0068032 A1* 2/2019 Saito ..... H02K 11/33
2019/0271496 A1* 9/2019 Sigmund ..... F25C 1/10

* cited by examiner

ICE MAKER FOR A DOMESTIC REFRIGERATION APPLIANCE WITH AN EJECTION UNIT AND A TWISTING APPARATUS, DOMESTIC REFRIGERATION APPLIANCE AND METHOD

CROSS-REFERENCE TO RELATED APPLICATION

This application claims the priority, under 35 U.S.C. § 119, of German application DE 10 2017 211 714.1, filed Jul. 10, 2017; the prior application is herewith incorporated by reference in its entirety.

BACKGROUND OF THE INVENTION

Field of the Invention

The invention relates to an ice maker for a domestic refrigeration appliance. The ice maker has an ice tray, which has at least one cavity for holding and freezing liquid to form a shaped ice element. The ice maker also has an ejection unit for ejecting a shaped ice element from the cavity. The ice maker also has a drive apparatus for performing a relative rotational movement between the ice tray and the ejection unit to eject the shaped ice element from the cavity. The invention also relates to a domestic refrigeration appliance with an ice maker as well as a method for producing at least one shaped ice element using an ice maker.

There exits many different known configurations of domestic refrigeration appliances. Appliances are also known, which have a chiller compartment and a freezer compartment. An ice maker unit can be arranged in the freezer compartment as well as in the chiller compartment. In appliances, in which the ice maker unit is arranged in the chiller compartment, provision is made for the ice maker unit itself to be thermally insulated in an appropriate manner. Provision is also made with such configurations for shaped ice elements or crushed ice produced by the ice maker unit to be chilled appropriately on the way from the ice maker unit to an output unit of the domestic refrigeration appliance in order to prevent melting.

An ice maker for a domestic refrigeration appliance is described in German published patent application DE 10 2010 038 378 A1. Here shaped ice elements arranged in an ice tray are ejected using an ejection unit, which is configured in the manner of a rake. To facilitate this, a heating facility on the ice tray provides heat to melt the shaped ice elements so that they can be ejected more easily from the cavity. The ice tray itself can be rotated about an axis, but only as a whole and without changing its shape.

That configuration of the prior art ice maker uses a heating facility, which is an additional component, and which also requires electrical energy.

SUMMARY OF THE INVENTION

It is accordingly an object of the invention to provide an ice maker, a refrigeration appliance and an ejection method which overcome the above-mentioned and other disadvantages of the heretofore-known devices and methods of this general type and to provide an ice maker, a domestic refrigeration appliance and a method, with which shaped ice elements can be removed from an ice tray easily but in an energy-efficient manner.

With the foregoing and other objects in view there is provided, in accordance with the invention, an ice maker for a domestic refrigeration appliance, the ice maker comprising:

an ice tray formed with at least one cavity for holding and freezing a liquid to form a shaped ice element;

an ejection unit for ejecting the shaped ice element from said at least one cavity;

a drive apparatus for performing a relative rotational movement between said ice tray and said ejection unit for ejecting the shaped ice element from said at least one cavity; and a twisting apparatus coupled to said ice tray and configured to selectively twist said ice tray to release a frozen shaped ice element in said cavity.

One aspect of the invention relates to an ice maker for a domestic refrigeration appliance. The ice maker has an ice tray. The ice tray has at least one cavity for holding and freezing liquid to form a shaped ice element. The ice maker also has an ejection unit, which allows a shaped ice element to be ejected from the cavity of the ice tray. The ice maker also has a drive apparatus for performing a relative rotational movement between the ice tray and the ejection unit to allow the shaped ice element to be ejected from the cavity. The ice maker also has a twisting apparatus, which is coupled to the ice tray and can be used to twist the ice tray around to release a frozen shaped ice element in the cavity. Such a twisting apparatus therefore allows a certain release of the shaped ice element to be achieved by twisting the ice tray itself and not just by simply rotating said ice tray as a whole without deformation. This allows the ejection unit then to eject the shaped ice element easily from the cavity.

In view of the invention it is therefore no longer necessary to provide a heating facility in the ice maker to heat the ice tray, in order to melt the shaped ice elements. The proposed ice maker therefore allows simple production and removal of a shaped ice element in the ice tray in a manner that is also extremely energy-efficient. In particular there is no need for electrical energy for a heating facility.

The twisting apparatus preferably has a rotating unit, which is connected to a first end of the ice tray. The twisting apparatus also has a holding unit, which is connected to a second end of the ice tray. Rotation of the rotating unit relative to the holding unit allows the ice tray to be twisted around in a defined manner. Both ends of the ice tray are thus twisted relative to one another, thereby producing the twisted state of the ice tray. The ice tray is twisted in particular about a longitudinal axis of the ice tray. In the twisted state the ice tray is therefore twisted in a spiral or helical manner.

In accordance with an added feature of the invention, the holding unit has a first stop, which is arranged to overlap with the second end in the direction of a longitudinal axis of the ice tray. This achieves a very simple mechanical coupling principle for holding the ice tray.

In accordance with an additional feature of the invention, the holding unit has a second stop, which is arranged to overlap with the second end when viewed in the direction of the longitudinal axis of the ice tray, one of the two stops resting against an upper face of the ice tray and the other stop resting against a lower face of the ice tray. This second end of the ice tray is thus tensioned between the specifically positioned stops. This avoids unwanted movement tolerances of the ice tray. In particular this configuration also allows the ice tray to be twisted both in a clockwise direction about a longitudinal axis of the ice tray and also counterclockwise.

In accordance with another feature of the invention, the ice maker has at least one detection unit for detecting a frozen state of the liquid in the cavity. This advantageously identifies whether the liquid introduced has already frozen sufficiently for the ice tray to be twisted, so that liquid still present does not run out in an unwanted manner and/or the shaped ice element does not break into many pieces on twisting due to its as yet insufficiently frozen state.

Provision is preferably made for the twisting apparatus to be configured to twist the ice tray through an azimuth angle of at least 10°, in particular between 10° and 80°. The azimuth angle here is measured in the circumferential direction about the longitudinal axis of the ice tray. Such specific angle data on the one hand allows twisting that does not damage the ice tray per se while on the other hand releasing the shaped ice element in the cavity sufficiently so that it can then be easily ejected. This prevents unwanted blocking of the ejection unit when attempting to eject the shaped ice element. It prevents overloading of and therefore also damage to an electronic unit, in particular a motor, generating the rotational movement of the ejection unit.

In accordance with yet an added feature of the invention, the ejection unit is configured in the manner of a rake with blades that are able to rotate about a rotation axis. This creates a highly functional principle for making contact with the shaped ice elements in a reliable and extensive manner, allowing them to be guided out of the cavity by means of a simple continuous movement.

The rake blades can preferably be rotated through an angle between 90° and 180°. In one advantageous embodiment provision is therefore also made for the rake blades not to be configured as infinitely rotating but only to be able to pivot through this specific rotation angle. This allows the ice maker to have a very compact structure, as the radially projecting rake blades do not therefore require space, a large amount of which would also be required above the ejection unit.

Provision is therefore made in particular with this embodiment for the rake blades to be able to be rotated both clockwise and counterclockwise about their rotation axis. It is therefore possible for the rake blades to be rotated through an angle cited as advantageous above in one direction about the rotation axis for the purpose of ejection and to be rotated back to their initial position in the counter direction when a shaped ice element has been ejected from a cavity.

In accordance with a concomitant feature of the invention, the novel ice maker does not have a heating facility for melting the shaped ice element in the cavity.

With the above and other objects in view there is also provided, in accordance with the invention, a domestic refrigeration appliance which is equipped with an ice maker as detailed above.

With the above and other objects in view there is also provided, in accordance with the invention, a method for producing a shaped ice element, or a plurality of shaped ice elements, with an ice maker for a domestic refrigeration appliance. The novel method comprises:

producing a shaped ice element in a cavity of an ice tray of the ice maker by freezing a liquid in the cavity;

twisting the ice tray with a twisting apparatus of the ice maker in order to release the shaped ice element in the cavity; and subsequently ejecting the frozen shaped ice element from the cavity with an ejection unit of the ice maker.

That is, a further aspect of the invention relates to a method for producing at least one shaped ice element using an ice maker for a domestic refrigeration appliance. With the method a shaped ice element is produced in a cavity of an ice tray of the ice maker by freezing a liquid in the cavity. The frozen shaped ice element is ejected from the cavity using an ejection unit of the ice maker. Before such sliding-in of the shaped ice element from the cavity the ice tray is twisted around using a twisting apparatus of the ice maker, to release the shaped ice element in the cavity. The advantages also achieved with the method have already been cited above in relation to the ice maker.

In accordance with yet an added feature of the invention, a check is made before the ice tray is twisted whether or not the liquid in the cavity has frozen to form a shaped ice element.

In accordance with again an advantageous feature of the invention, the ice tray is twisted through an azimuth angle of at least 10°. The azimuth angle may lie within the range between 10° and 80°.

In one advantageous embodiment the ice tray is also rotated back from its twisted position to its non-twisted basic position before the shaped ice element is ejected from the cavity. This facilitates the ejection operation for the shaped ice element, as the rake blades of the ejection unit in particular can then be passed through the cavity without becoming trapped.

The ejection unit is preferably rotated through an azimuth angle between 90° and 180° about its rotation axis in a first rotation direction to eject the shaped ice element and then rotated back in a second rotation direction counter to the first rotation direction after the shaped ice element has been ejected. Because there is no complete rotation through 360°, the ice maker can have a structure that takes up little space.

The terms "above," "below," "in front," "behind," "horizontal," "vertical," "depthwise direction," "widthwise direction," "heightwise direction," etcetera indicate the positions and orientations defined when the ice maker or appliance is used and arranged in the correct manner.

Further features of the invention will emerge from the claims, figures and description of the figures. The features and feature combinations cited above in the description and the features and feature combinations cited below in the description of the figures and/or simply shown in the figures can be used not only in the combinations cited in each instance but also in other combinations, without departing from the scope of the invention. Therefore embodiments of the invention not specifically shown and described in the figures but which emerge and can be produced from the embodiments described based on separate features combinations should also be considered to be covered and disclosed. Also embodiments and feature combinations which therefore do not contain all the feature of an originally formulated independent claim should be considered to be disclosed. Embodiments and feature combinations, which go beyond or deviate from the feature combinations set out in the claim references, should also be considered to be disclosed, in particular by the embodiments set out above.

BRIEF DESCRIPTION OF THE SEVERAL VIEWS OF THE DRAWING

Structurally and functionally identical elements are identified with identical reference characters throughout the figures.

DETAILED DESCRIPTION OF THE INVENTION

Figure 1:
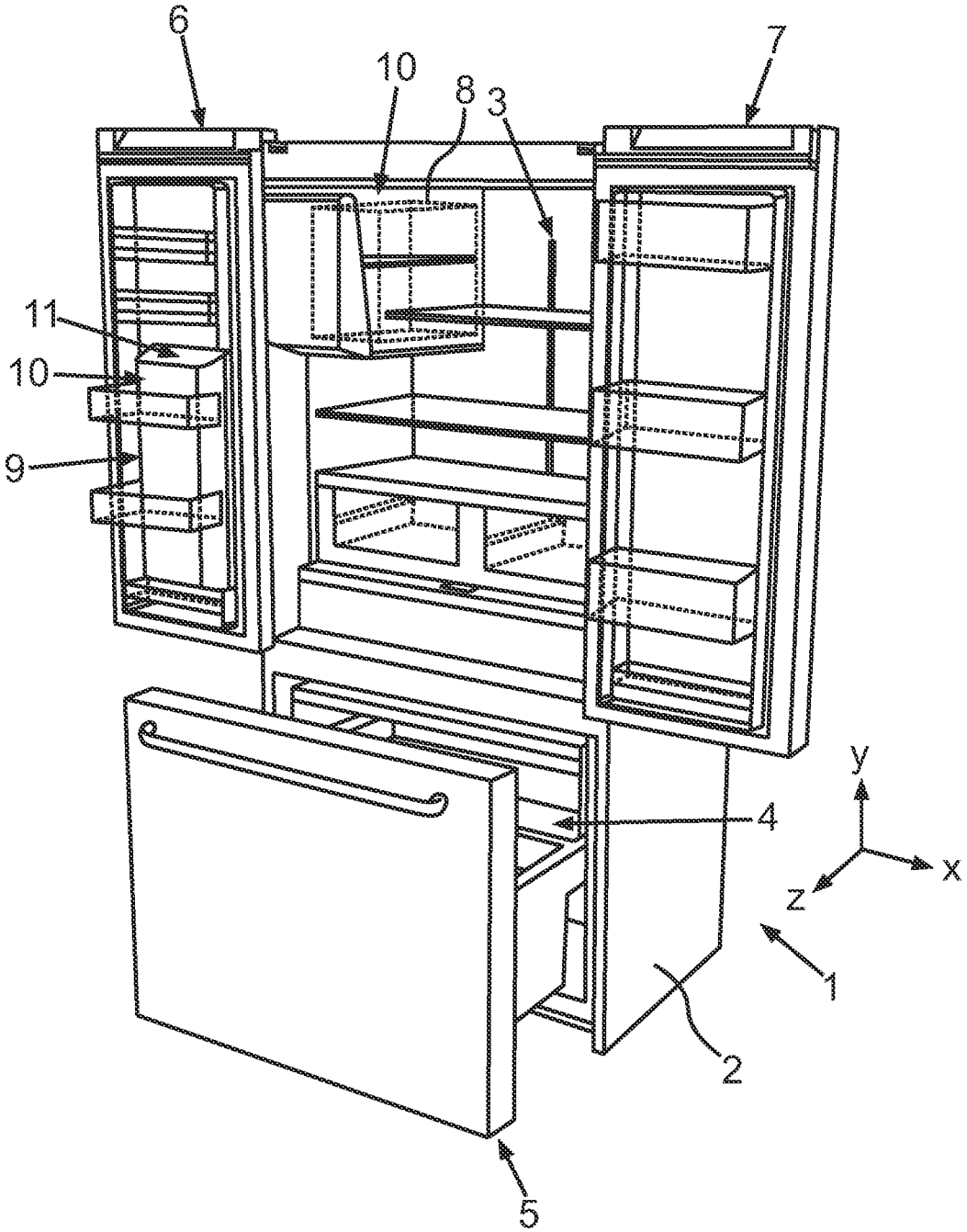
FIG. 1 shows a perspective diagram of an exemplary embodiment of an domestic refrigeration appliance according to the invention.

Referring now to the figures of the drawing in detail and first, particularly, to FIG. 1 thereof, there is shown a perspective diagram of an exemplary embodiment of a domestic refrigeration appliance 1. The domestic refrigeration appliance 1 is configured to store and conserve food. In the illustrated exemplary embodiment the domestic refrigeration appliance 1 is a combined refrigerator/freezer appliance. It may, however, just be a refrigerator.

The illustrated domestic refrigeration appliance 1 has an external housing 2. A first chamber for holding food is configured in the external housing 2, in this instance a chiller compartment 3. The domestic refrigeration appliance 1 also has a second chamber for holding food, in this instance a freezer compartment 4, which is separate from the first chamber. As shown, in the embodiment illustrated here the chiller compartment 3 and freezer compartment 4 are arranged one above the other in the heightwise direction (y-direction) of the domestic refrigeration appliance 1. The freezer compartment 4, which is arranged further below, can be closed by a door 5. In the illustrated exemplary embodiment the door 5 is a front wall of a drawer, which can be moved linearly in the depthwise direction (z-direction) of the domestic refrigeration appliance 1. The chiller compartment 3 can be closed at the front by two separate doors 6 and 7, shown in the opened state in FIG. 1. The two separate doors 6 and 7 can be pivoted by way of pivot axes, which are oriented vertically, and are arranged on the external housing 2. The two doors 6 and 7 are arranged next to one another in the widthwise direction (x-direction) and extend in a front plane in the closed state. In particular the door 5 also extends in the same plane in the closed state as the one in which the two doors 6 and 7 extend in the closed state.

The domestic refrigeration appliance 1 also has a dispenser unit 10, which is configured to output shaped ice elements or crushed ice. The dispenser unit 10 can also be configured optionally to output a beverage. The dispenser unit 10 has an ice maker 8 or ice maker unit. In the illustrated embodiment the ice maker 8 is arranged within the chiller compartment 3. This means that the ice maker 8 is configured and arranged to be thermally insulated from the chiller compartment 3 but can only be accessed and reached by way of the loading opening of the chiller compartment 3. That is, the ice maker 8 can only be made accessible when at least the door 6 is opened.

In addition to the ice maker 8 the dispenser unit 10 also has an output unit 9. In this instance the output unit 9 is integrated in the door 6 by way of example. A recess, into which a vessel can be inserted, and into which the shaped ice elements or crushed ice can then be output by way of the output unit 9, is disposed on an outer face of the door 6 facing away from the chiller compartment 3 and thus forming a front face.

When the door 6 is in the closed state, the output unit 9 is coupled to the ice maker 8 so that shaped ice elements or crushed ice can pass from the ice maker 8 to the output unit 9 by way of an ice chute 11 configured here in the output unit 9.

Figure 2:
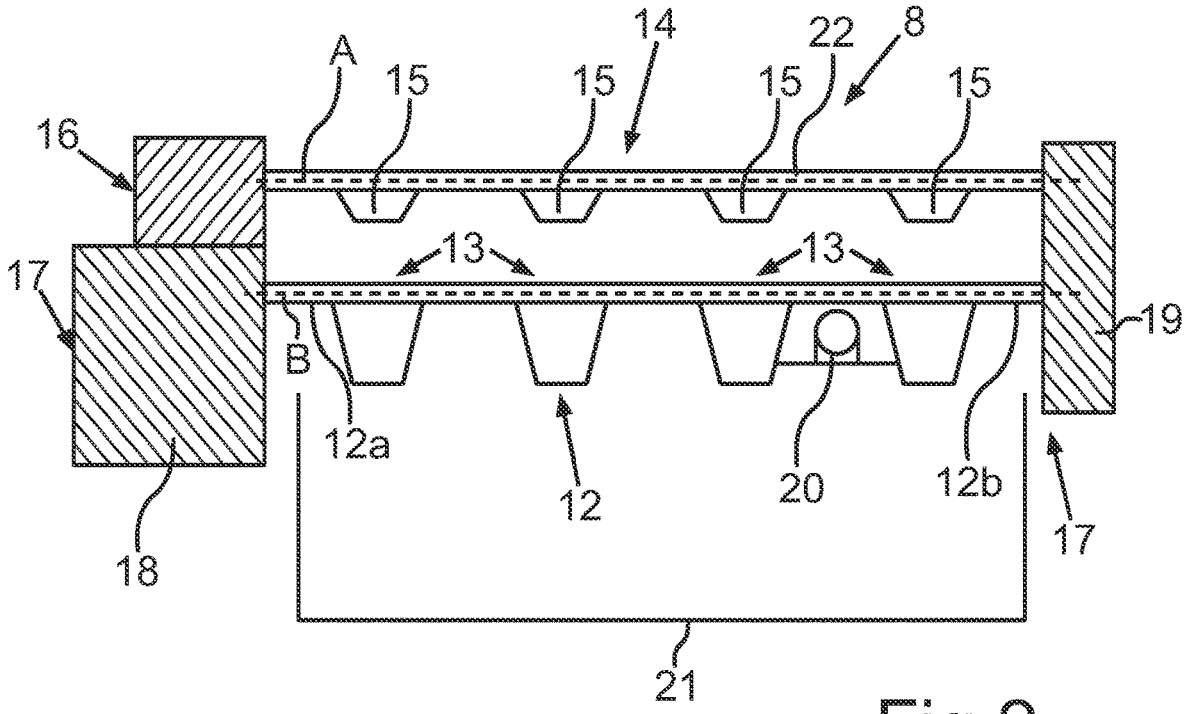
FIG. 2 shows a schematic side view of an exemplary embodiment of an ice maker according to the invention with an ice tray in the non-twisted basic position.

FIG. 2 shows a schematic side view of the ice maker 8. It has an ice tray 12. In the present exemplary embodiment a number of depressions are configured as cavities 13 in said ice tray 12, it being possible for liquid to be introduced therein to be frozen to form shaped ice elements. Said ice maker 8 also has a separate ejection unit 14, which can be used to eject shaped ice elements in the cavities 13 from said cavities 13. The ejection unit 14 here is configured in the manner of a rake, having a number of rake blades 15 or tines 15. The ice maker 8 also has a drive apparatus 16, which can be used to rotate the ejection unit 14 about a rotation axis A, so that the rake blades 15 rotate. Provision is made here in particular for a rotation angle between 90° and 180° to be possible. There is no provision for a complete rotation.

A relative rotational movement between the ice tray 12 and the ejection unit 14 allows the shaped ice elements to be ejected from the cavities 13.

In one advantageous embodiment the ice maker 8 also has a further unit, which is a twisting apparatus 17. The twisting apparatus 17 allows the ice tray 12 to be twisted around. The ice tray 12 has a longitudinal axis B, about which twisting takes place.

As shown schematically in FIG. 2, a front end 12*a*, which is a first end, of the ice tray 12 is connected to a rotating unit 18 of the twisting apparatus 17. A second end 12*b* of the ice tray 12 located opposite in the direction of the longitudinal axis B is connected to a holding unit 19 of the twisting apparatus 17. In particular this second end 12*b* is held, in particular tensioned, in a fixed position on the holding unit 19, which is also arranged in particular in a fixed position. When the first end 12*a* is twisted about the axis B relative to the second end 12*b*, the ice tray 12 is twisted around.

The ice maker 8 preferably has at least one detection unit 20, in particular a temperature sensor, to detect the temperature of the ice tray 12. It can then be determined whether the liquid in the cavities 13 is already frozen and therefore ejectable shaped ice elements are present.

It is thus first checked from the production and ejection of the shaped ice elements whether the shaped ice elements have already frozen sufficiently. It is only once this has been determined, by a control unit of the ice maker 8 or a control unit of the domestic refrigeration appliance 1, that the ice tray 12 is then twisted. Twisting is performed in such a manner that the ice tray 12 is twisted from a non-connected basic position and then moved back into the basic position. It is only when this basic position is reached again that the ejection unit 14 is actuated. In particular, the rake blades 15 are rotated so as to engage in the cavities 13 and to eject the released shaped ice elements therefrom.

The ice maker 8 is configured without a heating facility for heating the ice tray 12, so the shaped ice elements in the ice tray 12 are not melted before being ejected.

During ejection said ejection unit 14 is rotated from a basic position through an azimuth angle about the axis A between 90° and 180°. After all the shaped ice elements are ejected from the cavities 13 in this process, the unit is rotated back to the basic position in the counter direction about the axis A.

FIG. 2 also shows a container 21 of the ice maker 8 simply by way of example, this being arranged below the ice tray 12, the ejected shaped ice elements being introduced therein. The stored shaped ice elements are then conveyed out of the container 21 as required, in particular with a spiral conveyor, and then conveyed by way of the ice chute 11 to the output unit 9.

Figure 3:
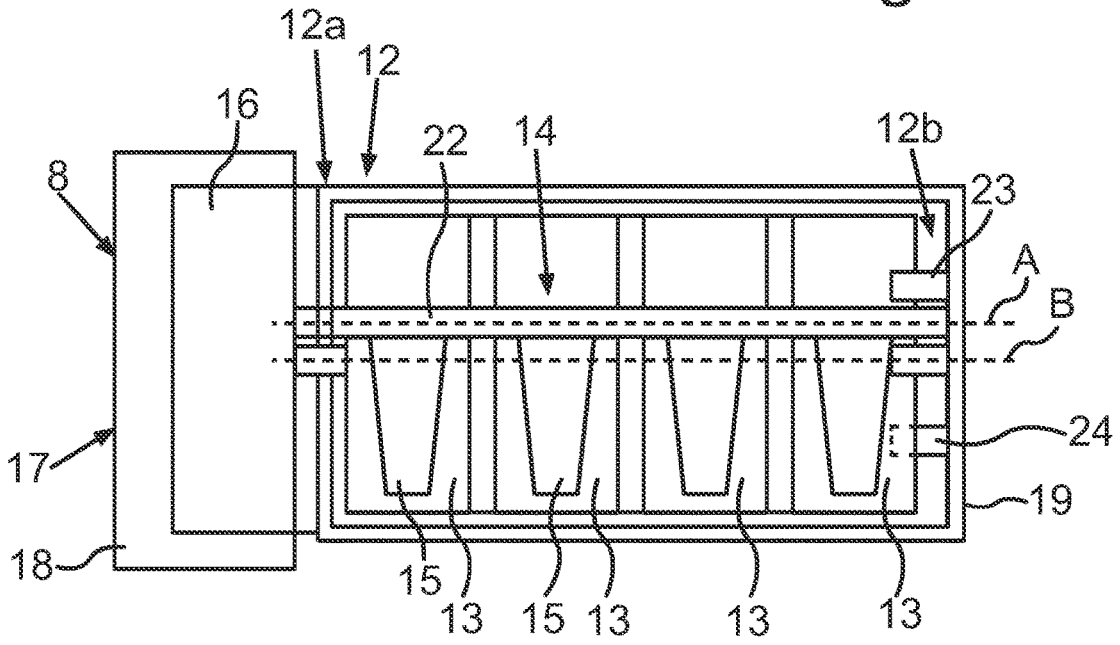
FIG. 3 shows a top view of the ice maker according to FIG. 2.

FIG. 3 shows a schematic top view of the ice maker 8 according to FIG. 2. The rake blades 15 are shown here, tapering in particular toward a free end and away from a rotating bar 22. The cavities 13 here are configured in particular as cylinder segment volumes so a shaped ice element is a cylinder segment. As also shown in FIG. 3, in one advantageous embodiment provision is made for the holding unit 19 to have at least one first stop 23. Preferably, a second stop 24 is also provided. In particular said second end 12*b* of the ice tray 12 is tensioned between said stops 23 and 24. Provision can thus be made for the first stop 23 to rest against an upper face of said second end 12*b* and for the second stop 24 to rest against a lower face of the ice tray 12 in the region of the second end 12*b*. As the stops 23 and 24 are in a fixed position and the holding unit 19 is also in a fixed position, but the first end 12*a* can be rotated about the axis B using the rotating unit 18, the ice tray 12 is twisted around.

In particular twisting takes place here from the basic position through an azimuth angle about the axis B between 10° and 80°.

Figure 4:
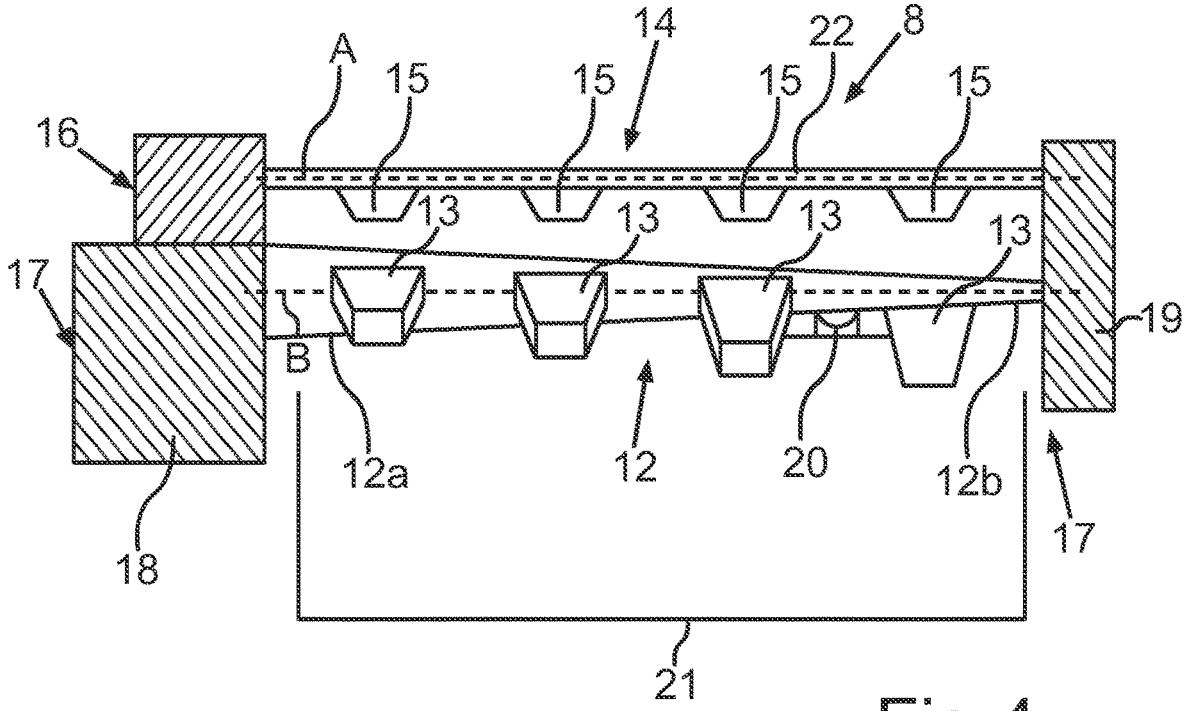
FIG. 4 shows a schematic side view of an exemplary embodiment of the ice maker according to FIG. 2 with a twisted ice tray.

FIG. 4 shows the diagram according to FIG. 2 but with the ice tray 12 shown in the twisted position, as opposed to the non-twisted basic position shown in FIG. 2.

Figure 5:
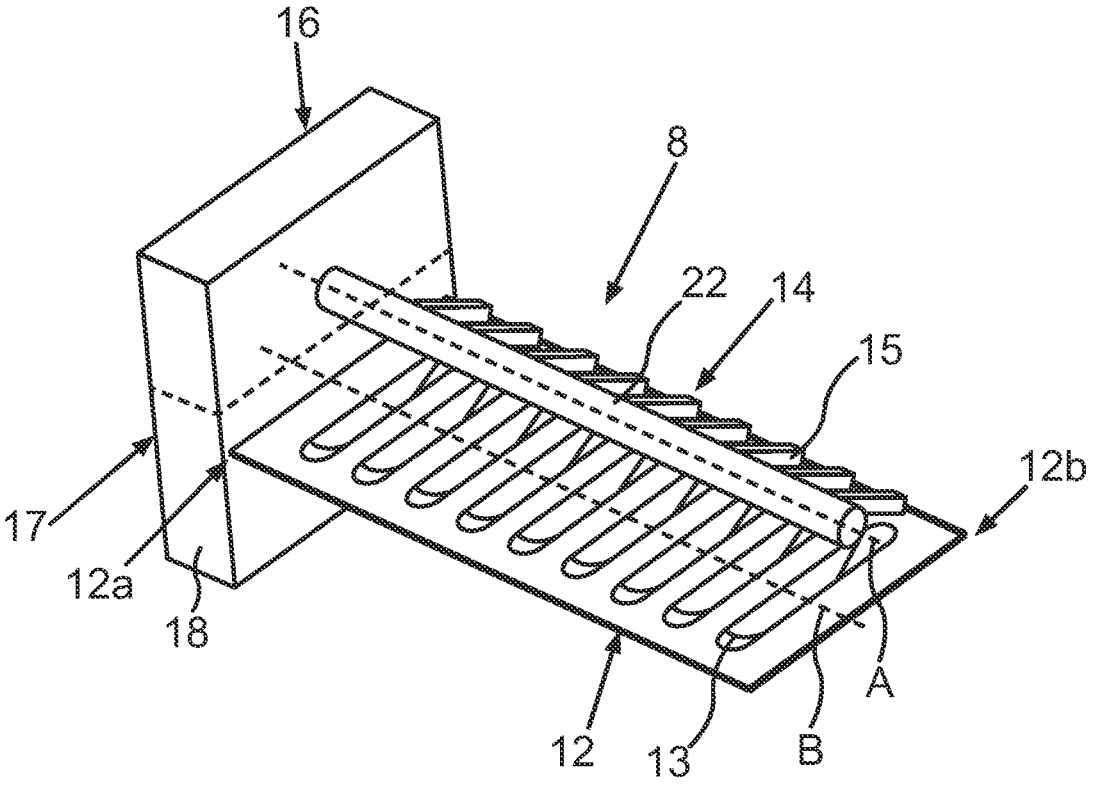
FIG. 5 shows a perspective diagram of components of the ice maker according to FIG. 2 to FIG. 4 with the ejection unit of the ice maker in its basic position.
Figure 6:
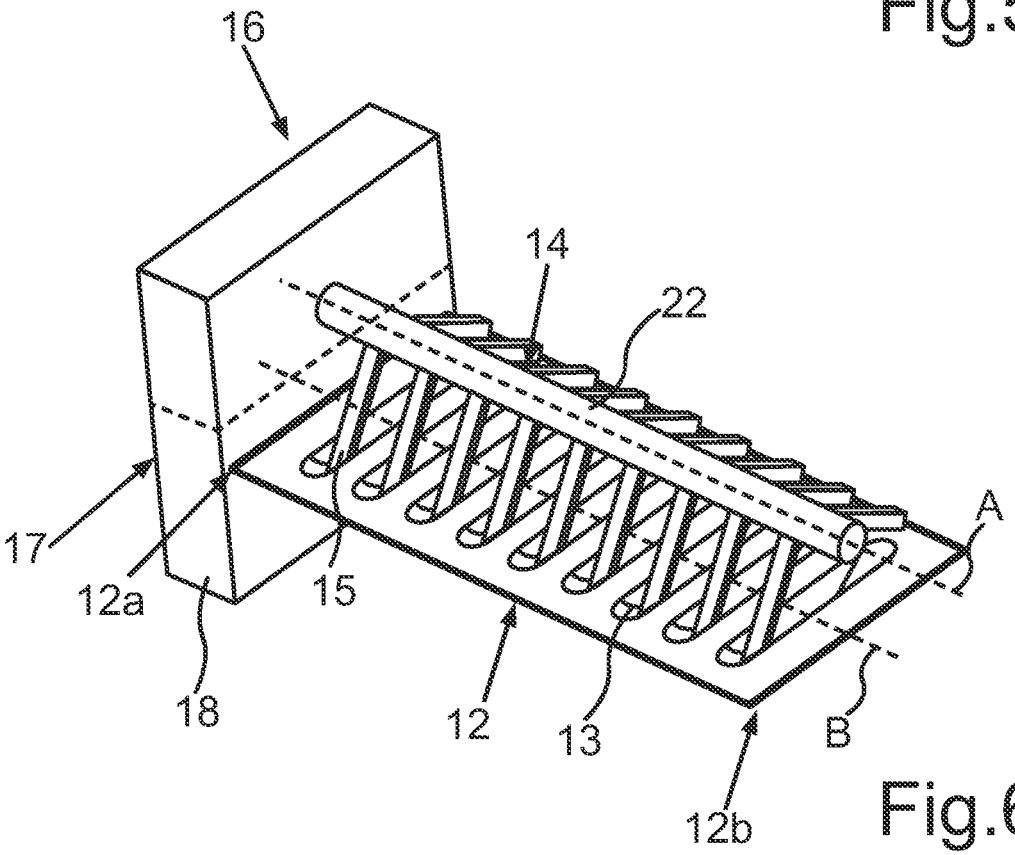
FIG. 6 shows the diagram according to FIG. 5, with the ejection unit shown in an ejection position.

FIG. 5 shows a perspective view of components of the ice maker 8. It shows the ejection unit 14 with the rake blades 15 in a basic position, in which the rake blades 15 do not yet engage in the cavities 13 of the ice tray 12. The holding unit 19 is not shown in the diagram in FIG. 5. FIG. 6 shows the diagram according to FIG. 5 but with the ejection unit 14 pivoted out of the basic position and the rake blades 15 engaging in the cavities 13, in particular in such a position that the shaped ice elements therein are all ejected from the cavities 13. From this in particular further maximum pivot position of the rake blades 15 they are then pivoted back into the basic position according to FIG. 5 in the counter direction.

Figure 7:
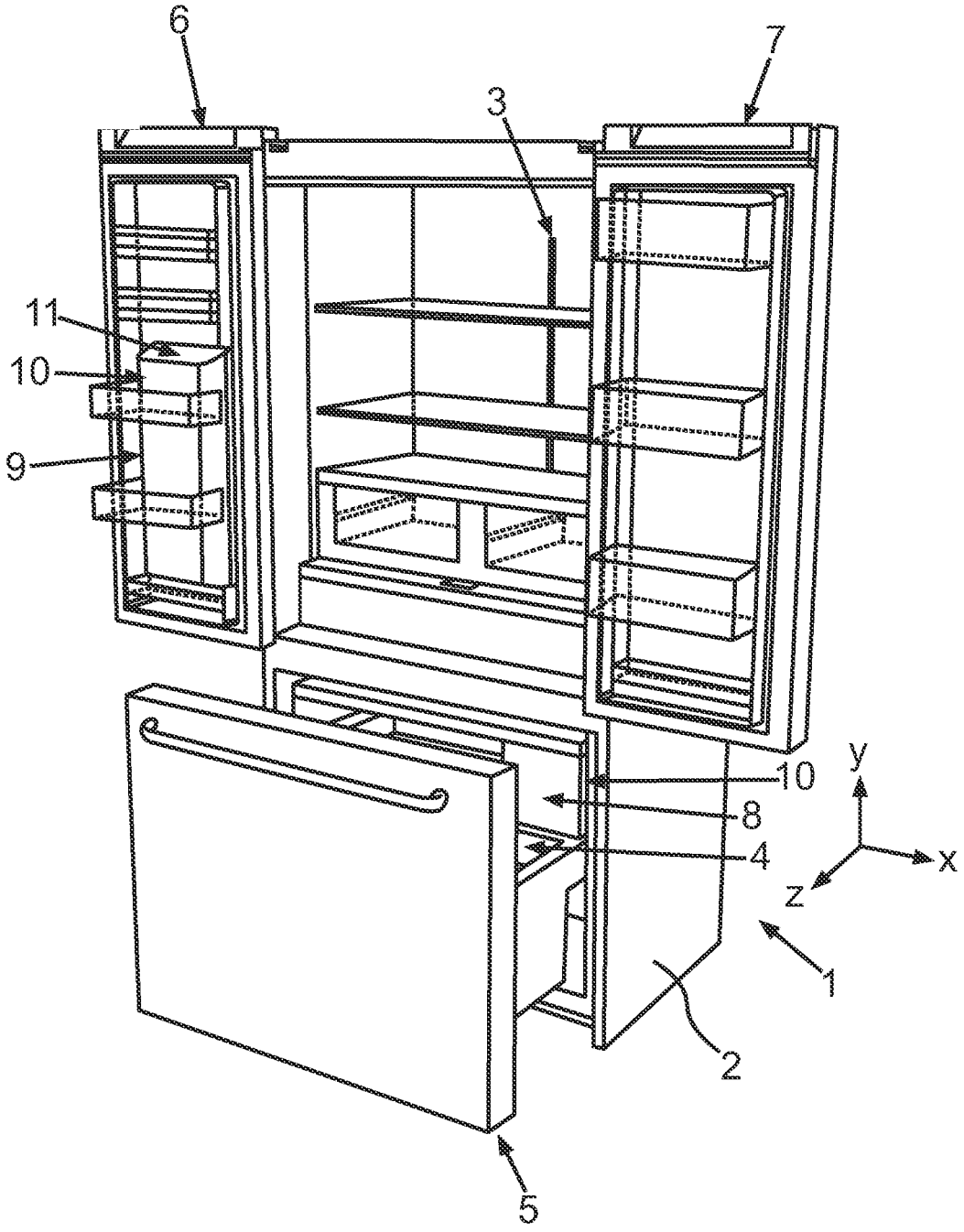
FIG. 7 shows a perspective diagram of a further exemplary embodiment of an inventive domestic refrigeration appliance.

FIG. 7 shows a further exemplary embodiment of a domestic refrigeration appliance 1, in which in contrast to FIG. 1 the ice maker 8 is arranged in a freezer compartment 4, which is configured here in particular below a chiller compartment 3. Provision can also be made for other positions of a freezer compartment and chiller compartment in a domestic refrigeration appliance 1.

The following is a summary list of reference numerals and the corresponding structure used in the above description of the invention:

1 Domestic refrigeration appliance
2 External housing
3 Chiller compartment
4 Freezer compartment
5 Door
6 Door
7 Door
8 Ice maker unit
9 Output unit
10 Dispenser unit
11 Ice chute
12 Ice tray
12*a* First end
12*b* Second end
13 Cavity
14 Ejection unit
15 Rake blades
16 Drive apparatus
17 Twisting apparatus
18 Rotating unit
19 Holding unit
20 Detection unit
21 Container
22 Rotating bar
23 Stop
24 Stop
A Rotation axis
B Longitudinal axis

The invention claimed is:

1. A method for producing a shaped ice element with an ice maker for a domestic refrigeration appliance, the method which comprises:

providing the ice maker with an ice tray having a first end and a second end located longitudinally opposite the first end, and mounting the first end of the ice tray to be rotated about an axis;

in the ice maker, producing a shaped ice element in a cavity of the ice tray of the ice maker by freezing a liquid in the cavity;

in the ice maker, twisting the ice tray by applying a rotational movement to the first end of the ice tray while holding the second end of the ice tray in a fixed position by at least one stop to twist the first end of the ice tray relative to the second end of the ice tray and thereby release the shaped ice element in the cavity;

after twisting the ice tray by applying the rotational movement to the first end of the ice tray while holding the second end of the ice tray in the fixed position, ejecting the shaped ice element, which is frozen, from the cavity with at least one rake blade of the ice maker; and after twisting the ice tray by applying the rotational movement to the first end of the ice tray while holding the second end of the ice tray in the fixed position, rotating the ice tray back from a twisted position to a non-twisted basic position prior to ejecting the shaped ice element from the cavity.

2. The method according to claim 1, which comprises, prior to twisting the ice tray by applying the rotational movement to the first end of the ice tray while holding the second end of the ice tray in the fixed position, checking whether the liquid in the cavity has frozen to form a shaped ice element.

3. The method according to claim 1, which comprises, when twisting the ice tray by applying the rotational movement to the first end of the ice tray while holding the second end of the ice tray in the fixed position, twisting the ice tray through an azimuth angle of at least 10°.

4. The method according to claim 1, which comprises, when twisting the ice tray by applying the rotational movement to the first end of the ice tray while holding the second end of the ice tray in the fixed position, twisting the ice tray through an azimuth angle of between 10° and 80°.

5. A method for producing a shaped ice element with an ice maker for a domestic refrigeration appliance, the method which comprises:

providing the ice maker with an ice tray having a first end and a second end located longitudinally opposite the first end, and mounting the first end of the ice tray to be rotated about an axis;

in the ice maker, producing a shaped ice element in a cavity of the ice tray of the ice maker by freezing a liquid in the cavity;

in the ice maker, twisting the ice tray by applying a rotational movement to the first end of the ice tray while holding the second end of the ice tray in a fixed position by at least one stop to twist the first end of the ice tray relative to the second end of the ice tray and thereby release the shaped ice element in the cavity;

after twisting the ice tray by applying the rotational movement to the first end of the ice tray while holding the second end of the ice tray in the fixed position, ejecting the shaped ice element, which is frozen, from the cavity by rotating at least one rake blade through an azimuth angle between 90° and 180° about a rotation axis of the ice tray in a first rotation direction; and rotating the at least one rake blade back in a second rotation direction, opposite the first rotation direction, after the shaped ice element has been ejected.

6. The method according to claim 5, which comprises, prior to twisting the ice tray by applying the rotational movement to the first end of the ice tray while holding the second end of the ice tray in the fixed position, checking whether the liquid in the cavity has frozen to form a shaped ice element.

7. The method according to claim 5, which comprises, when twisting the ice tray by applying the rotational movement to the first end of the ice tray while holding the second end of the ice tray in the fixed position, twisting the ice tray through an azimuth angle of at least 10°.

8. The method according to claim 5, which comprises, when twisting the ice tray by applying the rotational movement to the first end of the ice tray while holding the second end of the ice tray in the fixed position, twisting the ice tray through an azimuth angle of between 10° and 80°.

* * * * *